United States Patent [19]

Cunningham

[11] 3,976,147

[45] Aug. 24, 1976

[54] AUGER

[76] Inventor: Kelly G. Cunningham, P.O. Box 8155, 600 Goff Mtn. Road, Nitro, W. Va. 25143

[22] Filed: Jan. 23, 1975

[21] Appl. No.: 543,493

[52] U.S. Cl. ..... 173/22; 173/140; 173/163; 175/170

[51] Int. Cl.[2] ..... E04H 17/26

[58] Field of Search ..... 175/170; 173/22, 38, 173/163, 165, 166, 140

[56] References Cited

UNITED STATES PATENTS

| | | | |
|---|---|---|---|
| 382,689 | 5/1888 | Chapman | 173/166 X |
| 2,533,957 | 12/1950 | Roelfs | 173/163 |
| 2,565,224 | 8/1951 | Gibbens | 173/22 X |
| 2,592,402 | 4/1952 | Erdahl | 175/170 X |
| 2,604,304 | 7/1952 | Wilson | 173/163 X |
| 2,815,049 | 12/1957 | Herscovitch | 173/22 X |
| 3,756,090 | 9/1973 | Mella et al. | 173/163 X |

*Primary Examiner*—Ernest R. Purser
*Assistant Examiner*—William F. Pate, III
*Attorney, Agent, or Firm*—Sughrue, Rothwell, Mion, Zinn & Macpeak

[57] ABSTRACT

A safety earth auger is employed for forming post holes and in similar uses. The auger is supported pivotally beween elongated handles and is driven from an engine mounted on a remote frame. The frame has ground wheels which provide for stability during operation while permitting the frame to pivot as the auger enters the earth.

1 Claim, 5 Drawing Figures

AUGER

BACKGROUND OF THE INVENTION

1. Field of the Invention

This invention pertains to an earth auger, and more specifically, to an auger of the portable variety.

2. Statement of the Prior Art

Small augers of this general variety have been employed for a number of years. Typical examples in the patented art include the following:

| Patent | Patentee | Issued |
|---|---|---|
| 2,239,024 | Vance | April 22, 1941 |
| 2,286,583 | Shoup | June 16, 1942 |
| 2,320,775 | Garner | June 1, 1943 |
| 2,321,680 | Houston | June 15, 1943 |
| 2,410,508 | Lamme | Nov. 5, 1946 |
| 2,468,319 | Adams | April 26, 1949 |
| 2,746,720 | Cannon | May 22, 1956 |
| 3,452,829 | Smith | July 1, 1969 |

SUMMARY OF THE INVENTION

In the arrangement herein proposed, the auger is positioned between two handles which project from the engine support frame for the apparatus. The handles are manipulated by the operator, but the engine and frame are remotely located. In the event that the auger blade encounters an obstruction and is restricted from turning, the danger to the operator is minimized inasmuch as the frame and the engine are unlikely to be brought into contact with him. Also, the positioning is such that any danger of displacement of the engine is minimal.

The frame is mounted on ground wheels which serve the dual function of making the unit mobile in character, and also facilitating, in combination with the pivotal mounting of the auger relative to the handle, the unilinear movement of the auger into the earth.

The unit is provided with non-complex controls, and is of simple and efficient construction.

Other and further objects and advantages of the invention will become apparent to those skilled in the art from a consideration of the following specification when read in conjunction with the annexed drawings.

DESCRIPTION OF A PREFERRED EMBODIMENT

Figure 1:
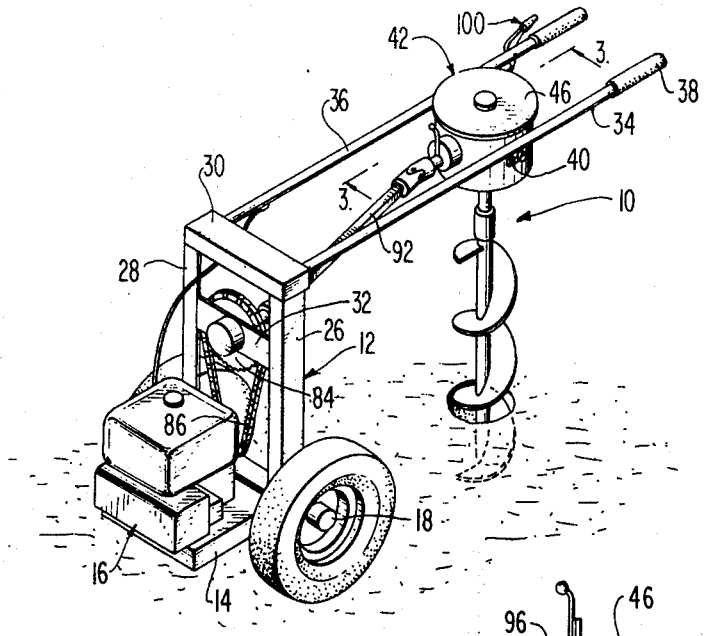
FIG. 1 is a perspective view showing an auger constructed and assembled in accordance with the teachings of this invention.

Referring to the drawings in more detail, a safety auger according to this invention is therein shown and generally identified by reference numeral 10. The auger assembly 10 includes a mobile frame 12 having a normally horizontal platform 14 for a small internal combustion engine 16 or other appropriate power source. At one end of the platform, a cross axle 18 is suitably mounted, and ground wheels 20 are provided thereon. The engine includes an output shaft 22 with a gear wheel (not specifically shown) on its outer end.

Vertically mounted on the aforesaid end of the platform above the axle is a back frame member 24 comprised of side bars 26, 28, a top cross bar 30 and an intermediate cross bar 32.

Projecting from the top cross bar in a direction opposite from that of the engine platform are two tubular handles 34 and 36. The handles are fitted at their distal extremities with grips 38 for ease of manipulation by the operator. Each handle has a depending bearing bracket 40.

A drive housing 42 is pivotally mounted between the handles 34 and 36. The drive housing 42 includes a base 44, a top 46, and an annular side wall 48. The side wall has a flange 50 to which the top 46 is removably attached by changable fasteners 52, and both the base and top have central openings with appropriate bearing assemblies 54, 56, respectively, therein. The side wall includes a projecting nozzle 58 having a rotatable gland 60 therein. Fixedly secured to the nozzle is a flange 62 which serves to delineate the position of a gear shift lever 64 which rotates the gland, for a purpose appearing below.

The pivotal mounting of the housing is accomplished through side pivot members 66 which are engaged in the bearing brackets 40 of the handles 34 and 36.

An elongated shaft 68 has an upper end portion 70 disposed within the housing 42 and a lower portion 72 extending therefrom. The lower portion carries an elongated earth auger 74 with an auger blade 76 secured in place by a connector 78.

Mounted on the upper end portion of the shaft within the housing are oppositely disposed, spaced apart double gears 80 and 82.

Figure 3:
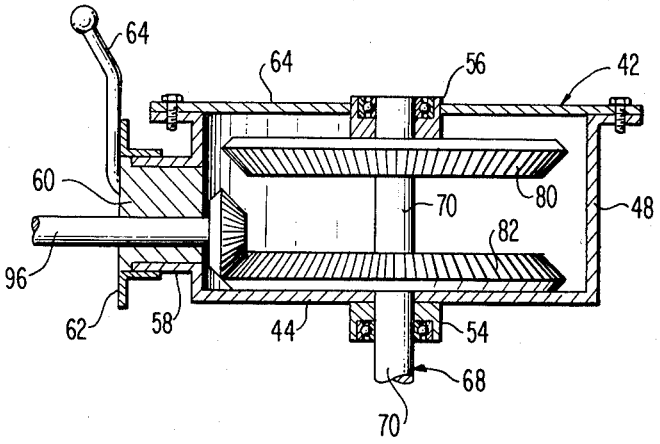
FIG. 3 is an enlarged sectional view taken on line 3—3 of FIG. 1, looking in the direction of the arrows.
Figure 4:
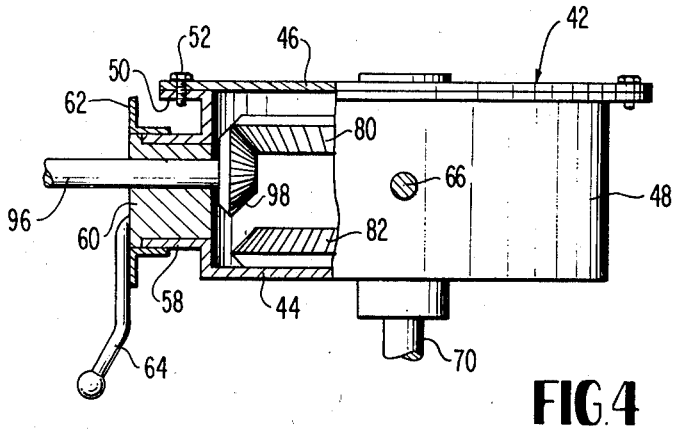
FIG. 4 is a view similar to FIG. 3 but of partial section showing gear reversal.
Figure 5:
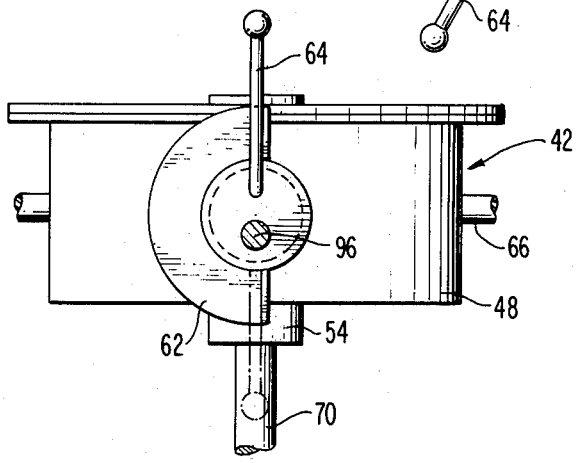
FIG. 5 is an elevational view of the gear housing from its forward portion with auger components removed for clarity of illustration.

The means for driving the gears 80 and 82 comprises a linkage from the engine 16, through its output shaft 22 and associated gear wheel. On the intermediate cross bar 32 is a second gear wheel 84 connected to the output shaft gear wheel by a drive chain 86. This drives a shaft 88 connected at a universal joint 90 to a further drive shaft 92 of variable length. The shaft 92 in turn is connected through a second universal joint 94 to a rotatable shaft 96 which extends rotatably through the gland 60. On the inner end of the shaft 96 is a bevel driving gear 98. The driving gear is selectively engagable with either of the gears 80 or 82 by rotation of the packing 60 through the movement of the lever 64. The alternate driving positions are shown in FIGS. 3 and 4, and it will be understood that these alternate positions result in opposite rotation of the shaft.

Figure 2:
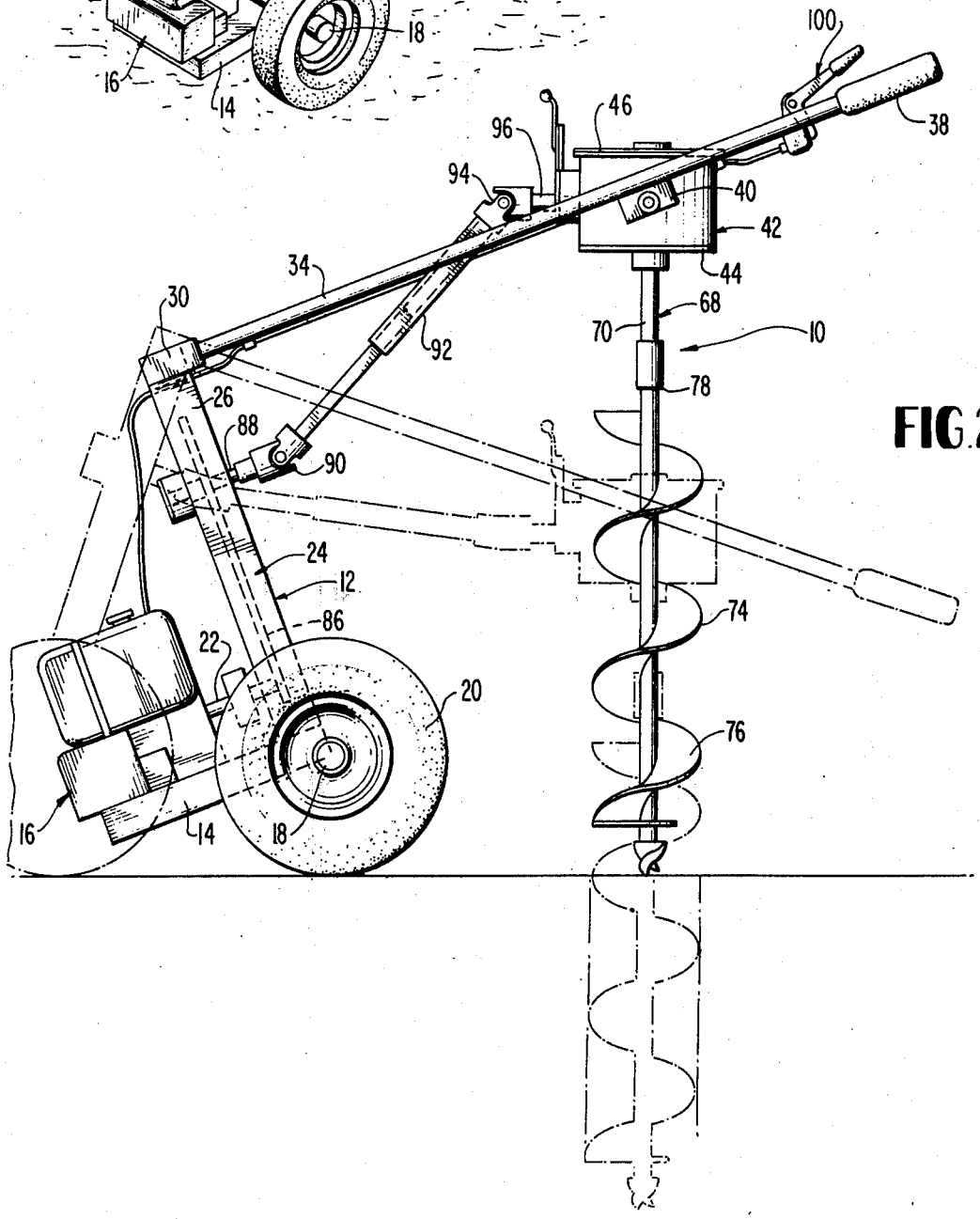
FIG. 2 is an enlarged side elevational view showing alternate operating positions in phantom lines.

In operation, the operator positions the auger blade as shown in full lines in FIG. 2 above the location to be drilled. The engine is then started and the operator applies a downward pressure to the hand grips 38 on the handles 34 and 36, thus permitting the auger to enter the earth at that point. As the auger is depressed to the phantom line position in FIG. 2, the frame pivots forwardly on the ground wheels and the housing pivots between the handles.

A suitable engine control 100 is provided on the handle 36 which permits the operator to discontinue engine operation from the safety position remote therefrom.

I claim:

1. A safety earth auger comprising:

a mobile frame comprising an engine platform, an axle mounted to said platform along one edge, round engaging wheels on said axle and on opposite sides of said platform, a back frame fixed to said platform parallel to and in general alignment with said axle and extending upwardly from said platform at right angles thereto, said back frame member comprising side bars on opposite sides of said platform adjacent said wheels and a top crossbar joining the upper ends of said side bar and forming an open framework, an intermediate crossbar spanning said open framework between said side bars intermediate of said platform and said top bar, an engine mounted on said platform;

a pair of straight elongated handle members each fixedly secured to the top crossbar at one end on respective sides and projecting generally parallel to each other in a direction opposite to said engine;

an enclosed drive housing including a base, a top and an annular side wall, pivot members projecting from said side wall at diametrically opposite locations and mounted to said handles intermediate the ends of said handles and said back frame member for pivoting said housing between said handles about an axis at right angles to said handles;

a shaft pivotably mounted within said enclosed drive housing, extending through said base, with an upper end portion within said housing and a lower end portion external of said housing and carrying an auger blade thereon, said shaft upper end portion carrying a pair of oppositely facing spaced coaxial gears, a rotatable gland carried by said drive housing side wall on the side facing said open back frame member, said gland eccentrically carrying a shaft including a drive gear internally of said drive housing annular wall for selective engagement with said oppositely facing double gears, said engine having a drive shaft extending towards said auger and terminating within said open back frame member, a gear wheel fixed to said engine drive shaft and positioned between said back frame side bars, an upper gear wheel rotatably mounted to said intermediate crossbar between said side bars, an endless drive chain engaging said gear wheels, and a shaft having universal joints on respective ends coupled through said universal joints respectively to said upper gear wheel and said drive carried by said gland, external of said drive housing and gear shift means carried by said gland and extending upwardly between said handle members;

whereby, said safety earth auger may be manually propelled and steered from behind said auger, said gears may be shifted, and said auger may be directed into the ground without change of position of the operator, and wherein the said drive chain is shielded by said open frame work and said universal shaft connection is shielded by said pair of handle bars to maximize protection of said operator during use of said auger.

* * * * *